United States Patent [19]

Rowe

[11] Patent Number: 4,938,443

[45] Date of Patent: Jul. 3, 1990

[54] VENETIAN BLIND INSTALLATION BRACKET

[75] Inventor: Norman D. Rowe, South Renovo, Pa.

[73] Assignee: Carey-McFall Corporation, Montgomery, Pa.

[21] Appl. No.: 279,358

[22] Filed: Dec. 2, 1988

[51] Int. Cl.[5] ..... A47H 1/14

[52] U.S. Cl. ..... 248/251; 248/221.4; 160/178.1; 160/902

[58] Field of Search ..... 248/251, 261, 262, 273, 248/224.2, 224.4, 221.4; 160/178.1, 902

[56] References Cited

U.S. PATENT DOCUMENTS

| | | | |
|---|---|---|---|
| 2,168,417 | 8/1939 | Lorentzen | 248/251 |
| 2,674,432 | 4/1954 | Lorentzen | 160/902 X |
| 2,745,486 | 5/1956 | Nelson | 160/178.1 |
| 4,071,215 | 1/1978 | Marotto | 248/251 |
| 4,224,974 | 9/1980 | Anderson et al. | 160/178.1 |
| 4,411,401 | 10/1983 | Anderson | 248/251 X |
| 4,438,897 | 3/1984 | Vecchiarelli | 248/544 |
| 4,475,706 | 10/1984 | Anderson | 248/542 |
| 4,580,753 | 4/1986 | Hennequin | 248/264 |
| 4,601,319 | 7/1986 | Georgopoulos | 160/178 B |
| 4,607,677 | 8/1986 | Comeau | 160/84 R |
| 4,607,818 | 8/1986 | Georgopoulos | 248/544 |
| 4,662,596 | 5/1987 | Haarer | 248/251 |
| 4,719,955 | 1/1988 | Tachikawa et al. | 160/168.1 |

FOREIGN PATENT DOCUMENTS

| | | | |
|---|---|---|---|
| 21434 | 6/1956 | Fed. Rep. of Germany | 248/262 |

*Primary Examiner*—David M. Purol

*Attorney, Agent, or Firm*—Lerner, David, Littenberg, Krumholz & Mentlik

[57] ABSTRACT

An installation bracket for a U-shaped venetian blind headrail having a resilient inner support including spaced connectors and spaced hooks for engaging support edges on the U-shaped headrail. An outer support is fastened to a support surface and engages and supports the ends of the spaced connectors. Tabs formed on the outer support keep the inner support in slight compression.

20 Claims, 3 Drawing Sheets

VENETIAN BLIND INSTALLATION BRACKET

BACKGROUND OF THE INVENTION

Venetian blind assemblies are typically mounted to the surface of ceilings or walls by means of a headrail. The connection between the headrail and the ceiling or wall surface is conventionally by way of headrail installation brackets which may take a variety of forms.

Prior art forms of support brackets for a venetian blind assembly are connected over the ends of the venetian blind headrail. Thus, U.S. Pat. Nos. 4,580,753 and 4,607,677 disclose support brackets having open-sided box structures with pivoting front members. In use, these box-brackets are readily observable and detract from the appearance of the venetian blind installation. Moreover, the bracket must be manufactured in a variety of colors to match the headrail, therefore necessitating increased manufacturing and inventory costs. Further, different shadings may exist between one lot of a color and another, which causes a mismatch between the brackets and the venetian blind headrail, thereby rendering the venetian blind installation less attractive.

Another form of prior art venetian blind headrail installation bracket is shown in U.S. Pat. Nos. 4,601,319 and 4,662,596 which also utilize end-supportive means. In this form of bracket, end members are inserted into opposing ends of the headrail and subsequently attached either directly or by a second bracket to a wall, ceiling or other supporting structure. As above, these end-supportive brackets will be visible after installation, and therefore raise the same kinds of objections.

Many conventional end-supportive brackets further must be manufactured to close tolerances in order to assure a tight, secure fit between the headrail and the bracket. In addition, both right-hand and left-hand brackets are often required. These circumstances necessarily increase the cost of tooling, manufacturing, and inventorying of the brackets A still further type of prior art bracket supports a headrail from points inward of the ends thereof. These brackets are used in conjunction with a generally U-shaped headrail having the longitudinally extending upper edges turned inwardly in order to form a support edge. Brackets of this type are disclosed in U.S. Pat. Nos. 4,438,897, 4,475,706 and 4,607,818.

Despite the existence of the aforementioned brackets, there is a need for improved support brackets for securely supporting a venetian blind headrail, so shaped and formed that in assembled position they do not detract from the appearance of the venetian blind installation, and which allow for the easy removal of the venetian blind headrail therefrom without the requirement of a tool.

The present invention discloses a bracket assembly that attempts to address these problems of the prior art devices by providing a relatively simple structure that is less costly to manufacture, and easier to install. In the improved bracket assembly in accordance with the present invention, a rigid outer support is adapted to be fastened to a support surface. The outer support houses a resilient inner support which includes hook members to engage and support the inwardly turned support edges of a venetian blind headrail. A friction member on the outer support is disposed in operative position to engage the rounded portion of the venetian blind headrail support edge in order to prevent lateral movement of the headrail with respect to the bracket assembly.

SUMMARY OF THE INVENTION

Thus, in accordance with the present invention, a bracket assembly for attaching a venetian blind headrail to a support surface has an inner support which includes connecting means and spaced hook means on the connecting means disposed for detachable engagement with the venetian blind headrail, an outer support having means for connection to a support surface, and means to engage and support the connecting means in order to hold the venetian blind headrail in operative association with the support surface, and retaining means on the outer support engage the connecting means and restrict relative movement thereof with respect to said support surface.

Additionally, in the bracket assembly as above-described wherein the connecting means has spaced connecting members, and resilient means operatively disposed between the spaced connecting members for forcing the spaced connecting members into secure engagement with the retaining members.

Additionally, the bracket assembly as first above described including, means to frictionally engage and hold the venetian blind headrail from lateral movement.

In accordance with a further embodiment of the invention, a venetian blind headrail assembly for attachment to a support surface is disclosed having a U-shaped venetian blind headrail, an inner support including, spaced connecting members and spaced hook means to engage and hold the venetian blind headrail, and an outer support having means to connect the outer support to the support surface, the outer support engaging and supporting the ends of the spaced connecting members in order to hold a venetian blind headrail in operative association with the support surface, and said outer support including, fixedly spaced retaining members for mating engagement with the spaced connecting members to prevent relative movement of the spaced connecting members away from each other.

Additionally, in the venetian blind headrail assembly as described above including, resilient means between the spaced connecting members for forcing the spaced connecting members against the retaining members.

Additionally, in the venetian blind headrail assembly as first described above including, means to frictionally engage and hold the venetian blind headrail from lateral movement.

Accordingly, it is an object of the present invention to provide a bracket assembly for attaching a venetian blind headrail to a support surface which has a relatively simple structure and is easy to install.

It is another object of the present invention to provide a bracket assembly for attaching a venetian blind headrail to a support surface which is inexpensive to manufacture.

It is yet another object of the present invention to provide a venetian blind headrail assembly wherein the bracket assembly is hidden from view, thereby producing a pleasing appearance.

It is a still further object of the present invention to provide a venetian blind installation having a headrail and an operatively associated bracket assembly wherein the headrail is easily attached to and removed from the bracket assembly without the use of any tools.

These and other objects will become apparent, as will a better understanding of the structure and operation of the present invention, when reference is made to the description which follows taken with the drawings in which:

DETAILED DESCRIPTION OF A PREFERRED EMBODIMENT

Figure 1:
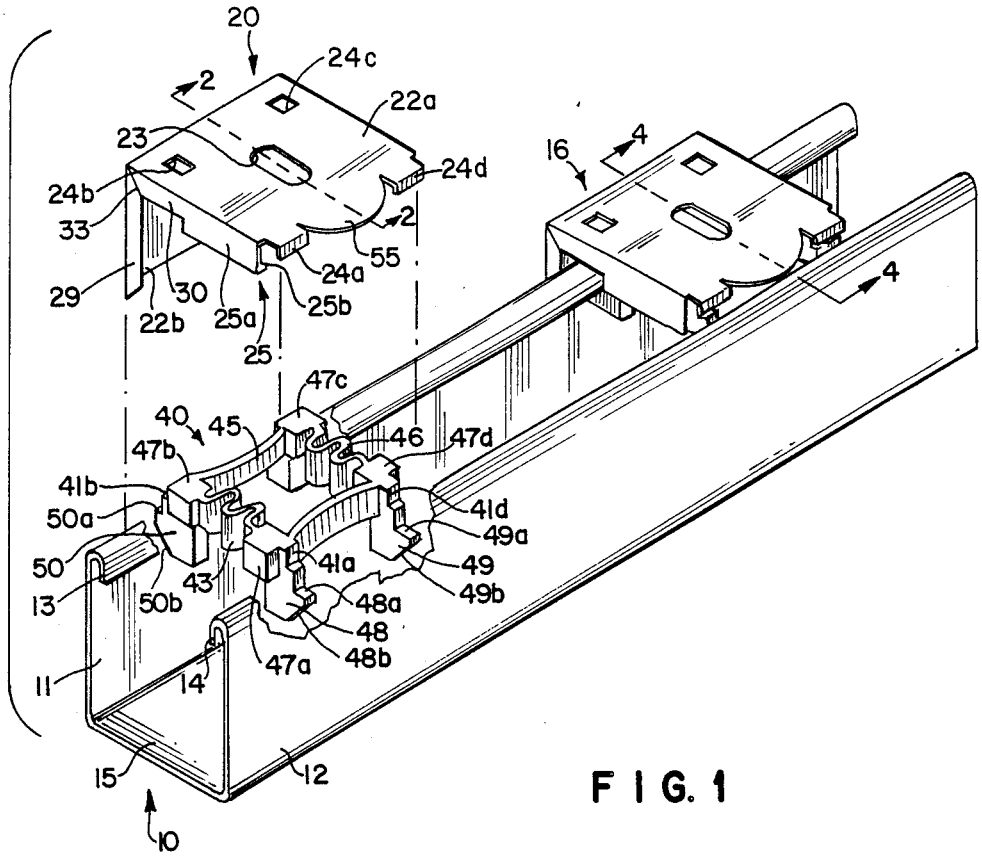
FIG. 1 is a perspective view showing one venetian blind headrail installation bracket in exploded view in assembled position on a venetian blind headrail, with the headrail broken away to show the detail of the first inner member, and also showing a second venetian blind headrail installation bracket in assembled position on the venetian blind headrail.

Referring to FIG. 1, there is illustrated a headrail 10 in assembled position on bracket assembly 16 constructed in accordance with the present invention. The headrail 10 is of a conventional construction and comprises a U-shaped channel member having vertically extending legs 11 and 12 joined by a horizontal web 15. The longitudinally extending edges of legs 11 and 12 on headrail 10 are turned inwardly to form support edges as at 13 and 14.

Bracket assembly generally designated 16 includes an L-shaped outer support 20. Outer support 20 is preferably struck or formed from an integral piece of sheet metal. Instead of sheet metal, however, another appropriate material could be used, or outer support 20 could be fabricated in several parts.

Figure 2:
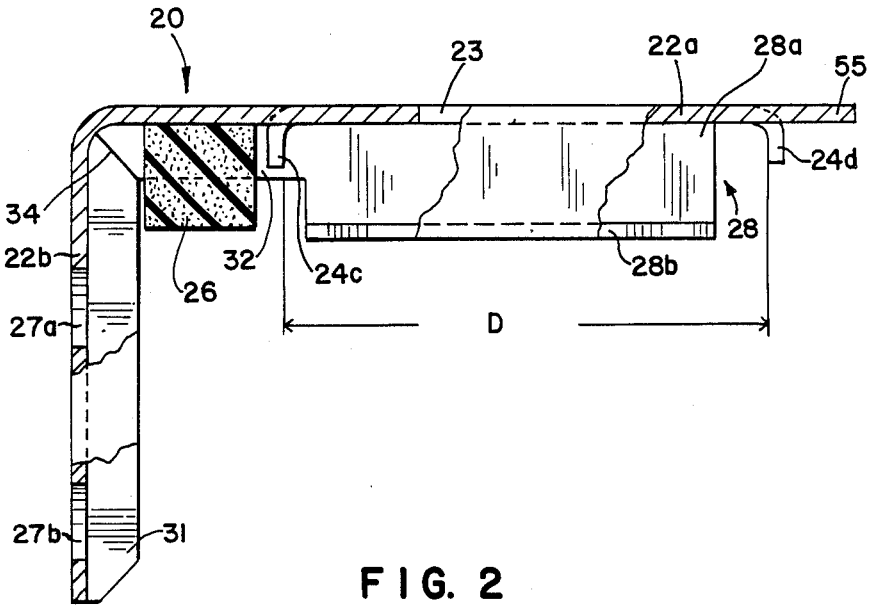
FIG. 2 is a cross-section taken on line 2—2 of the venetian blind headrail installation bracket shown in FIG. 1 partly in side elevational view.
Figure 3:
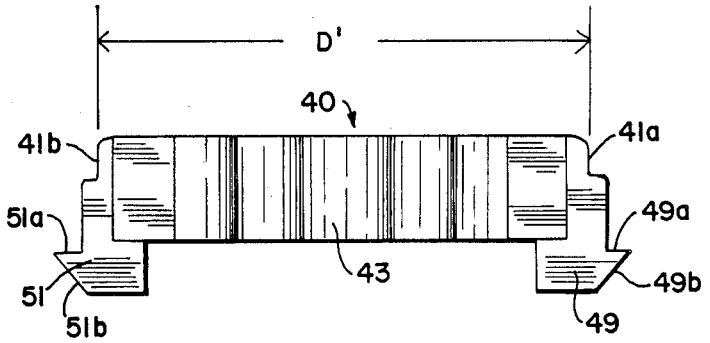
FIG. 3 is a side elevational view of the first inner member of the venetian blind installation bracket shown in FIG. 1.

As can be seen in FIGS. 1 and 2, outer support 20 has a horizontal leg **22*a* and a vertical leg 22*b*. Vertical leg 22*b* includes generally normal thereto edge supports 29 and 31 on its respective vertical edges, which act to mechanically strengthen vertical leg member 22*b*. Similarly, horizontal leg member 22*a* includes edge supports 30 and 32 generally normal thereto, which act to mechanically strengthen horizontal leg member 22*a*. Edge support members 29 and 30 supportively engage one another at 33, and edge support members 31 and 32 supportively engage each other at 34, thus increasing the supportive strength of outer support 20**.

Vertical leg member **22*b* is provided with holes 27*a* and 27*b* through which screws or other fastening means may be inserted for fastening outer support 20 to a wall or other vertical support surface. Similarly, horizontal leg member 22*a* is provided with elongated opening 23 through which a screw or other fastening means can be inserted for fastening outer support 20** to a ceiling, window frame, or other horizontal support surface.

FIGS. 1 and 2 further show horizontal leg member **22*a* as including channel members 25 and 28 depending from either said thereof. Channel member 25 has an upper leg formed by horizontal leg 22*a*, a side member 25*a* that is coextensive with horizontal edge support 30, and a bottom leg 25*b* formed a spaced distance from horizontal leg 22*a*. Channel member 28 includes an upper leg formed by horizontal leg 22*a*, a side member 28*a* coextensive with horizontal edge support 32, and a bottom leg 28*b* formed a spaced distance from horizontal leg 22*a*. Side channels 25 and 28 are sized to slidably engage connecting members 47*a*, 47*b*, 47*c*, and 47*d* formed on inner support 40**.

Outer support 20 is also shown in FIGS. 1 and 2 to include tab members **24*a*, 24*b*, 24*c*, and 24*d* depending downward from horizontal leg 22*a*, tab members 24*a* and 24*d* being spaced a fixed distance, D, from tab members 24*b* and 24*c***.

Curvilinear portion 55 is formed at the end of horizontal leg **22*a* opposite vertical leg 22*b*, as is clearly shown in FIG. 1. Curvilinear portion 55 extends beyond tab members 24*a* and 24*d*, so that in assembled position with headrail 10 it will be located above the rounded portion of headrail support edge 14. In assembling headrail 10 onto bracket assembly 16, curvilinear portion 55 will contact the rounded portion of headrail support edge 14, thereby preventing headrail support edge 14 from being pushed past horizontal leg 22*a*, so that support edge 14 will not become improperly engaged on the upper surface of horizontal leg 22*a***.

Figure 4:
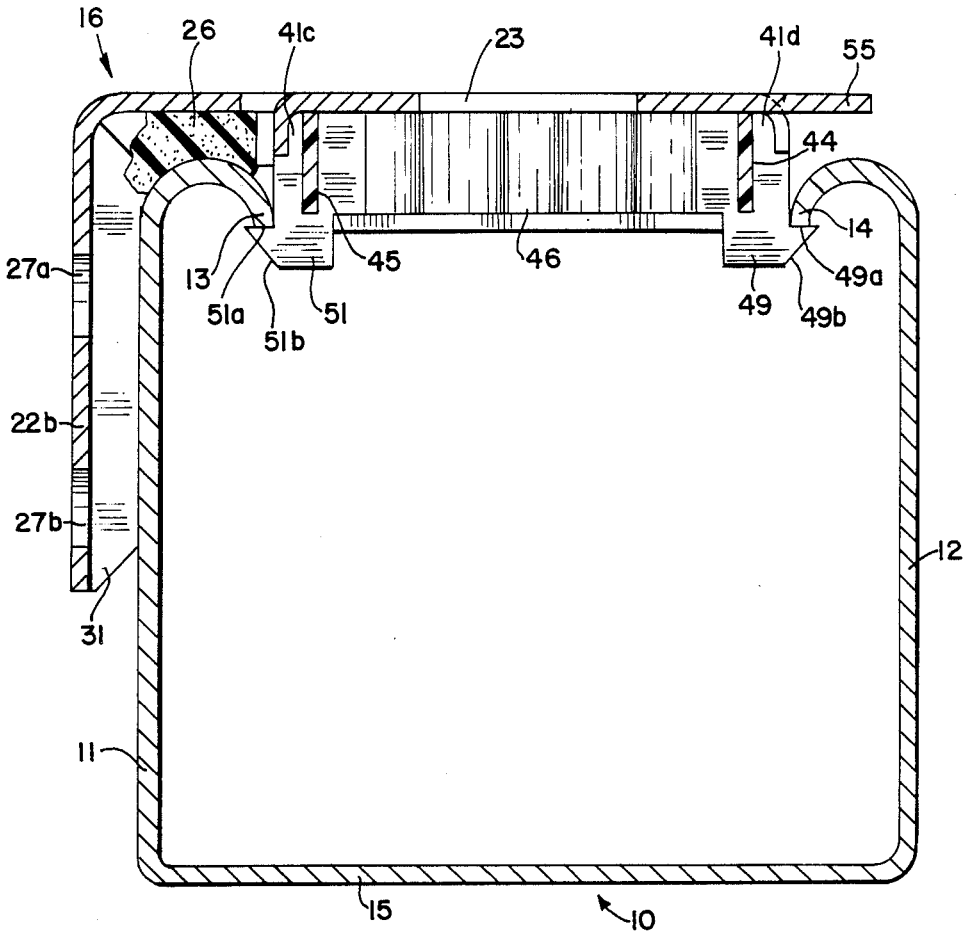
FIG. 4 is a cross-sectional view taken on line 4—4 of the second venetian blind headrail installation bracket shown in FIG. 1.

Friction member 26 is fixedly attached to outer support 20 between vertical leg member **22*b* and tab members 24*b* and 24*c*, as shown in FIGS. 2 and 4. In assembled position, friction member 26 will engage and be compressed by the rounded portion of headrail support edge 13, to frictionally hold support edge 13 in fixed position between friction member 26 and support shelves 50*a* and 51*a*, thereby preventing lateral movement of the headrail with respect to bracket assembly 16. Friction member 26 may be made of any suitable material, but typically is a readily compressible, resilient material which allows for greater tolerances in the size of the headrail support edge 13**.

Inner support 40 is made of a resilient material, preferably a resilient plastic or other like material. It has a generally rectangular shape in plan view, each corner of which includes a connecting member as at **47*a*, 47*b*, 47*c*, and 47*d*. Connecting members 47*a* and 47*d* are separated by resilient web 44. Similarly, connecting members 47*b* and 47*c* are separated by resilient web 45. Folded resilient member 43 is connected at one end to connecting member 47*a* and at an opposite end to connecting member 47*b*, whereas folded resilient member 46 is connected at one end to connecting member 47*c* and at an opposite end to connecting member 47*d***.

Connecting member **47*a* includes vertical face 41*a* for engagement with tab member 27*a* of outer bracket 20. Similarly, connecting members 47*b*, 47*c*, and 47*d* include vertical faces 41*b*, 41*c*, and 41*d*, respectively, for engagement with corresponding tab members 24*b*, 24*c*, and 24*d* in outer support 20**.

Extending downward from connecting member **47*a* is hook member 48, which includes support shelf 48*a* for mating engagement in assembled position with support edge 14 on headrail 10. Hook member 49 extends downward from connecting member 47*d* and similarly includes support shelf 49*a* for mating engagement in assembled position with support edge 14 on headrail 10**.

In like manner, connecting members **47*b* and 47*c* have hook members 50 and 51, respectively, extending downward therefrom, which in turn include support shelves 50*a* and 51*a*, respectively, for mating engagement in assembled position with support edge 13 on headrail 10**.

The lower portion of each hook member includes an outwardly tapered surface, as at **48*b*, 49*b*, 50*b*, and 51*b*, to aid in the installation of headrail 10 onto bracket assembly 16**, as described further below.

OPERATION AND USE OF BRACKET ASSEMBLY

In assembling inner support 40 and outer support 20 of bracket assembly 16, it is preferable that tab members 24*a* and 24*d* on the outer support 20 be initially in a horizontal position. Connecting member 47*b* is then aligned with channel 25, and connecting member 47*c* is aligned with channel 28, and inner support 40 can then slide axially into the outer support 20 until tab members 24*b* and 24*c* engage vertical faces 41*b* and 41*c*, respectively. At this point channel 25 will be in engagement with and will support both connecting members 47*a* and 47*b*, and channel 28 will be in engagement with and will support both connecting members 47*c* and 47*d*. Tab members 24*a* and 24*d* are then turned downward to engage vertical faces 41*a* and 41*d*, respectively, to securely retain inner support 40 within outer support 20.

In an alternate method of assembling inner support 40 and outer support 20 of bracket assembly 16, tab members 24*a*, 24*b*, 24*c* and 24*d* are all initially in a downwardly turned position, as shown in FIGS. 1 and 2. Inner support 40 is compressed and inserted into outer support 20. When the compressive force is released, inner support 40 expands until vertical faces 41*a*, 41*b*, 41*c* and 41*d* are engaged by tab members 24*a*, 24*b*, 24*c* and 24*d*, respectively.

The distance D' between vertical faces 41*a* and 41*b* in the unassembled position, and similarly between vertical faces 41*c* and 41*d* in the unassembled position is slightly larger than the distance D between tab members 24*a* and 24*b*, and tab members 24*c* and 24*d* in outer bracket 20. Thus, when in assembled position within outer bracket 20, folded resilient members 43 and 46 are in slight compression, and inner support 40 is securely held in outer support 20.

In installing a venetian blind headrail assembly according to the present invention, bracket assembly 16 is first fixedly attached to a wall support surface by screws or other fastening means through either holes 27*a* and 27*b*, or to a ceiling support surface by means of elongated opening 23 in outer support 20, or a combination thereof, whichever is appropriate. As best seen in FIG. 4, headrail 10 is then directed upwards against hook members 48, 49, 50, and 51. As the rounded portions of headrail support edges 13 and 14 engage tapered surfaces 48*b*, 49*b*, 50*b*, and 51*b*, they cause connecting members 47*a* and 47*b* to slide toward each other in channel 25, and connecting members 47*c* and 47*d* to slide toward each other in channel 28, thus causing resilient folded members 43 and 46 to compress further. Headrail 10 continues to be forced upward, the rounded portion of headrail support edge 13 compressing friction member 26, and headrail support edges 13 and 14 further compressing inner support 40, until support edges 13 and 14 snap over the outer edges of horizontal support shelves 48*a*, 49*a*, 50*a*, and 51*a*. At this point folded members 43 and 46 will expand so that headrail support edges 13 and 14 will be supported by the shelves, and the headrail will be mounted on the bracket assembly 16, all of which is shown in FIGS. 1 and 4 of the drawings. The friction member 26 restrains the headrail 10 from lateral movement, and also tends to urge the headrail support edge 13 firmly against support shelves 50*a* and 51*a*.

It can also be seen in FIG. 4 that the bracket assembly 16 is substantially hidden from view in assembled position by headrail 10, thereby preventing any unsightly appearance when the venetian blind headrail installation is completed.

In order to remove headrail 10 from bracket assembly 16, the headrail is either pulled forward or pushed backward. If the headrail is pulled forward, outer support tab members 24*a* and 24*d* hold hook members 48 and 49, respectively, in a fixed position relative to outer support 20. Folded members 43 and 46 are compressed as headrail 10 is pulled forward, until headrail support edge 14 disengages from support shelves 48*a* and 49*a*. Headrail leg 12 is then rotated downwardly so that headrail support edge 14 is clear of the bracket assembly 16. The headrail is then moved backward, allowing headrail support edge 13 to be released from shelves 50*a* and 51*a*.

In a like manner, the headrail 10 may be removed from the bracket assembly 16 by pushing the headrail backward. Tab members 24*b* and 24*c* in outer support 20 hold hook members 50 and 51 in fixed position relative to the outer support 20, so that as the headrail is pushed backward, compressing folded members 43 and 46, headrail support edge 13 disengages from support shelves 50*a* and 51*a*. Headrail leg 11 is then rotated downwardly to allow support edge 13 to clear bracket assembly 16. The headrail is then moved forward until headrail support edge 14 is released from support shelves 48*a* and 49*a*, thereby freeing the headrail 10 from the bracket assembly 16.

There has thus been described in detail the construction and use of an improved venetian blind headrail installation bracket and assembly. The bracket assembly in accordance with the present invention has a relatively simple structure which is inexpensive to manufacture. The headrail is easily installed on the bracket assembly by pushing it upwards against the bracket assembly, and readily released therefrom by pulling it forward or pushing it backward so as to disengage it from an inner support. In assembled position, the bracket assembly is substantially hidden from view by the venetian blind headrail so as not to detract from the appearance of the completed venetian blind installation.

While the foregoing description presents the preferred embodiments of the device and system in accordance with the present invention, it will be appreciated that certain changes and modifications may be made in the structure of these disclosed arrangements without departing from the spirit and scope of the invention as set forth in the appended claims.

I claim:

1. A bracket assembly for attaching a window treatment headrail to a support surface comprising, a. an inner support including at least two spaced connecting members, and at least two spaced hook members, said at least two spaced hook members being displaceable in opposite directions and disposed for engagement in assembled position to hold said window treatment headrail, b. an outer support having means to attach said outer support to the support surface, and c. said outer support including means operatively disposed to releasably engage said at least two spaced connecting members in assembled position to hold the window treatment headrail in operative association with the support surface, and spaced retaining means for mating engagement with said at least two spaced connecting members in assembled position for enabling the displacement of said at least two spaced hook members relative to said window treatment headrail.

2. A bracket assembly according to claim 1 wherein a first of said at least two spaced hook members is disposed adjacent to a first of said at least two spaced connecting members, and a second of said at least two spaced hook members is disposed adjacent to a second of said at least two spaced connecting members.

3. A bracket assembly according to claim 1 including resilient means between said at least two spaced connecting members for forcing said at least two spaced connecting members against said retaining means.

4. A bracket assembly according to claim 3 wherein said resilient means comprises, a folded member having a first end connected to one of said at least two spaced connecting members and a second end connected to a second of said at least two spaced connecting members.

5. A bracket assembly according to claim 1 wherein said means operatively disposed to releasably engage said connecting means comprises, channels on said outer support, said channels disposed for slidable engagement with the ends of said at least two spaced connecting members.

6. A bracket assembly according to claim 5 wherein said channels are generally U-shaped.

7. A bracket assembly according to claim 1 wherein said retaining means comprise, tab members depending downwardly from said outer support.

8. A bracket assembly according to claim 1 including, means disposed on said outer support for frictional engagement with the headrail in assembled position to restrain said headrail from lateral movement.

9. A bracket assembly according to claim 8 wherein said means disposed on said outer support for frictional engagement with the headrail in assembled position comprises, a resilient member to hold said headrail from lateral movement.

10. A bracket assembly according to claim 1 wherein said outer support includes a first leg extending in a generally horizontal plane and a lip member extending from said first leg in said generally horizontal plane for preventing the over-installation of said headrail on said bracket assembly.

11. A window treatment headrail assembly for attachment to a support surfacer comprising, a. a U-shaped window treatment headrail, b. an inner support including at least two spaced connecting members, and at least two spaced hook members, said at least two spaced hook members being displaceable in opposite directions and disposed for engagement in assembled position to hold said window treatment headrail, c. an outer support having means to attach said outer support to the support surface, and d. said outer support including means operatively disposed to releasably engage said at least two spaced connecting members in assembled position to hold the window treatment headrail in operative association with the support surface, and spaced retaining means for mating engagement with said at least two spaced connecting members in assembled position to enable the displacement of said at least two spaced hook members relative to said window treatment headrail.

12. The combination as claimed in claim 11 wherein a first of said at least two spaced hook members is disposed adjacent to a first of said at least two spaced connecting members, and a second of said at least two spaced hook members is disposed adjacent to a second of said at least two spaced connecting members.

13. The combination as claimed in claim 11 including, resilient means between said at least two spaced connecting members for forcing said at least two spaced connecting members against said retaining means.

14. The combination as claimed in claim 13 wherein said resilient means comprises, a folded member having a first end connected to one of said at least two spaced connecting members and a second end connected to a second of said at least two spaced connecting members.

15. The combination as claimed in claim 11 wherein said means operatively disposed to releasably engage said at least two spaced connecting members comprises, channels on said outer support, said channels disposed for slidably engagement with the ends of said at least two spaced connecting members.

16. The combination as claimed in claim 15 wherein said channels are generally U-shaped.

17. The combination as claimed in claim 11 wherein said retaining means comprise, tab members depending from said outer support.

18. The combination as claimed in claim 11 including, means disposed on said outer support for frictional engagement with the headrail in assembled position to hold said headrail from lateral movement.

19. The combination as claimed in claim 18 wherein said means disposed on said outer support for frictional engagement with the headrail in assembled position comprises, a resilient member to hold said headrail from lateral movement.

20. The combination as claimed in claim 11 wherein said outer support includes a first leg disposed in a generally horizontal plane and a lip member extending from said first leg in said generally horizontal plane for preventing the over-installation of said headrail on said bracket assembly.

* * * * *

UNITED STATES PATENT AND TRADEMARK OFFICE

CERTIFICATE OF CORRECTION

PATENT NO. : 4,938,443

DATED : July 3, 1990

INVENTOR(S) : ROWE

It is certified that error appears in the above-identified patent and that said Letters Patent is hereby corrected as shown below:

Column 7, line 18, delete "connecting means" and insert --at least two spaced connecting members--.

Column 7, line 43, delete "surfacer" and insert --surface--.

Signed and Sealed this

Fifteenth Day of October, 1991

*Attest:*

HARRY F. MANBECK, JR.

*Attesting Officer*

*Commissioner of Patents and Trademarks*